US010119532B2

(12) United States Patent
Cordatos et al.

(10) Patent No.: US 10,119,532 B2
(45) Date of Patent: Nov. 6, 2018

(54) SYSTEM AND METHOD FOR COOLING ELECTRICAL COMPONENTS USING AN ELECTROACTIVE POLYMER ACTUATOR

(71) Applicant: Hamilton Sundstrand Corporation, Charlotte, NC (US)

(72) Inventors: Haralambos Cordatos, Colchester, CT (US); Brian St. Rock, Andover, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 319 days.

(21) Appl. No.: 14/623,319

(22) Filed: Feb. 16, 2015

(65) Prior Publication Data

US 2016/0237999 A1 Aug. 18, 2016

(51) Int. Cl.

| | |
|---|---|
| ***F04B 43/04*** | (2006.01) |
| ***F04B 43/02*** | (2006.01) |
| ***F04B 43/00*** | (2006.01) |
| ***F04B 45/047*** | (2006.01) |
| ***F04B 45/027*** | (2006.01) |

(Continued)

(52) U.S. Cl.

CPC ..... *F04B 43/046* (2013.01); *F04B 19/006* (2013.01); *F04B 35/04* (2013.01); *F04B 43/0054* (2013.01); *F04B 43/023* (2013.01); *F04B 43/043* (2013.01); *F04B 45/027* (2013.01); *F04B 45/04* (2013.01); *F04B 45/047* (2013.01); *F04B 53/08* (2013.01)

(58) Field of Classification Search

CPC ..... F04B 53/08; F04B 43/0054; F04B 45/04; F04B 45/041; F04B 43/0027; F04B 43/023; F04B 19/006; F04B 17/003; F04B 43/025; F04B 45/027; F04B 45/02

See application file for complete search history.

(56) References Cited

U.S. PATENT DOCUMENTS 6,123,145 A * 9/2000 Glezer ..... B64C 21/08 165/104.33

6,376,971 B1 4/2002 Pelrine et al.

(Continued)

FOREIGN PATENT DOCUMENTS

| | | |
|---|---|---|
| EP | 1323925 | 7/2003 |
| WO | 2009132651 | 11/2009 |

(Continued)

OTHER PUBLICATIONS

Extended European Search Report dated Jul. 7, 2016 in European Application No. 16155997.6.

(Continued)

*Primary Examiner* — Bryan Lettman
*Assistant Examiner* — Timothy P Solak
(74) *Attorney, Agent, or Firm* — Snell & Wilmer, L.L.P.

(57) ABSTRACT

A spot-cooling system including an electroactive polymer actuator, an enclosure defining an internal cavity, and a port in the enclosure is described herein. The electroactive polymer actuator may be configured to draw air into the enclosure. The electroactive polymer actuator may be configured to force air from the enclosure. The electroactive polymer actuator may comprise a corrugated electroactive polymer actuator. The electroactive polymer actuator may comprise a plurality of layered electroactive polymer actuators.

8 Claims, 6 Drawing Sheets

(51) Int. Cl.

| | |
|---|---|
| ***F04B 53/08*** | (2006.01) |
| ***F04B 35/04*** | (2006.01) |
| ***F04B 19/00*** | (2006.01) |
| ***F04B 45/04*** | (2006.01) |

(56) References Cited

U.S. PATENT DOCUMENTS

| | | | | |
|---|---|---|---|---|
| 7,034,432 | B1 * | 4/2006 | Pelrine | F02G 1/043 310/309 |
| 8,421,316 | B2 | 4/2013 | Tryson et al. | |
| 8,692,442 | B2 | 4/2014 | Poole et al. | |
| 2003/0214199 | A1 * | 11/2003 | Heim | F04B 35/045 310/309 |
| 2004/0008853 | A1 * | 1/2004 | Pelrine | A61M 5/142 381/191 |
| 2004/0068224 | A1 | 4/2004 | Couvillon et al. | |
| 2004/0265150 | A1 * | 12/2004 | McElfresh | B81B 3/0035 417/413.1 |
| 2005/0089415 | A1 * | 4/2005 | Cho | F04B 43/046 417/413.2 |
| 2006/0074325 | A1 * | 4/2006 | Karo | A61B 5/02141 600/494 |
| 2006/0232167 | A1 * | 10/2006 | Jordan | F04B 43/0054 310/324 |
| 2007/0114885 | A1 * | 5/2007 | Benslimane | B81B 3/007 310/311 |
| 2007/0200468 | A1 | 8/2007 | Heim | |
| 2007/0289734 | A1 * | 12/2007 | McDonald | E21B 34/06 166/66.5 |
| 2009/0148320 | A1 * | 6/2009 | Lucas | F04B 43/046 417/481 |
| 2010/0221124 | A1 * | 9/2010 | Ikushima | F04B 43/0045 417/44.2 |
| 2011/0150669 | A1 * | 6/2011 | Frayne | F04B 35/045 417/53 |
| 2011/0240752 | A1 * | 10/2011 | Meacham | F04B 19/20 239/4 |
| 2011/0277968 | A1 * | 11/2011 | Chao | F04B 43/043 165/120 |
| 2012/0170216 | A1 * | 7/2012 | Arik | F04B 43/0027 361/688 |
| 2014/0034270 | A1 * | 2/2014 | de Bock | H05K 7/20172 165/80.3 |

FOREIGN PATENT DOCUMENTS

| | | |
|---|---|---|
| WO | 2013120494 | 8/2013 |
| WO | 2015020698 | 2/2015 |

OTHER PUBLICATIONS

Y. Bar-Cohen. Electroactive Polymer (EAP) Actuators as Artificial Muscles: Reality, Potential, and Challenges. 2004. (pp. 707, 709-723). SPIE.

PolyPower® DEAP actuator elements. DANFOSS Polypower A/S—White Paper. Available at www.polypower.com. Dec. 11, 2012. (pp. 1-17).

* cited by examiner

SYSTEM AND METHOD FOR COOLING ELECTRICAL COMPONENTS USING AN ELECTROACTIVE POLYMER ACTUATOR

FIELD

The present disclosure relates heat sinks, and more particularly, to systems and methods of increasing the efficiency of heat sinks.

BACKGROUND

Conventional air-cooled heat sinks are inadequate to meet the heat fluxes associated with high-performance computing anticipated in future flight vehicles. Part of the reason is the low overall efficiency in converting electrical power to air flow with typical fan-based cooling schemes.

SUMMARY

The present disclosure relates to a heat sink system. More particularly, according to various embodiments, a spot-cooling system including an electroactive polymer actuator, an enclosure defining an internal cavity, and a port in the enclosure is disclosed. The electroactive polymer actuator may be configured to draw air into the enclosure. The electroactive polymer actuator may be configured to force air from the enclosure. The electroactive polymer actuator may comprise a corrugated electroactive polymer actuator. The electroactive polymer actuator may comprise a plurality of layered electroactive polymer actuators.

According to various embodiments, the port is configured to act as an air inlet and an air outlet. The port may be an outlet, wherein the enclosure comprises a check valve inlet. The spot-cooling system may comprise a diaphragm coupled to the electroactive polymer actuator configured to draw air into and out of the internal cavity. The port may be disposed in close proximity to an electrical component. At least part of the internal cavity may be formed by the electroactive polymer actuator. The spot-cooling system may be configured to at least one of draw hot air away from an electrical component or actively flow relatively cooler air on the electrical component.

According to various embodiments, a method of spot-cooling is described herein. The method may include removing an application of a first voltage to an electroactive polymer actuator to cause the electroactive polymer actuator to contract.

The method may include drawing air into an enclosure defining an internal cavity via the contraction. The method may include applying a second voltage to the electroactive polymer actuator to cause the electroactive polymer actuator to expand. The method may include forcing air from the enclosure via expanding. The electroactive polymer actuator may comprise a corrugated electroactive polymer actuator. Air may be drawn into a port. The port may be a check valve inlet, wherein the enclosure comprises a check valve outlet. The port may be configured to act as an air inlet and an air outlet. The air may be drawn into the enclosure via a diaphragm coupled to the electroactive polymer actuator.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

Figure 1:
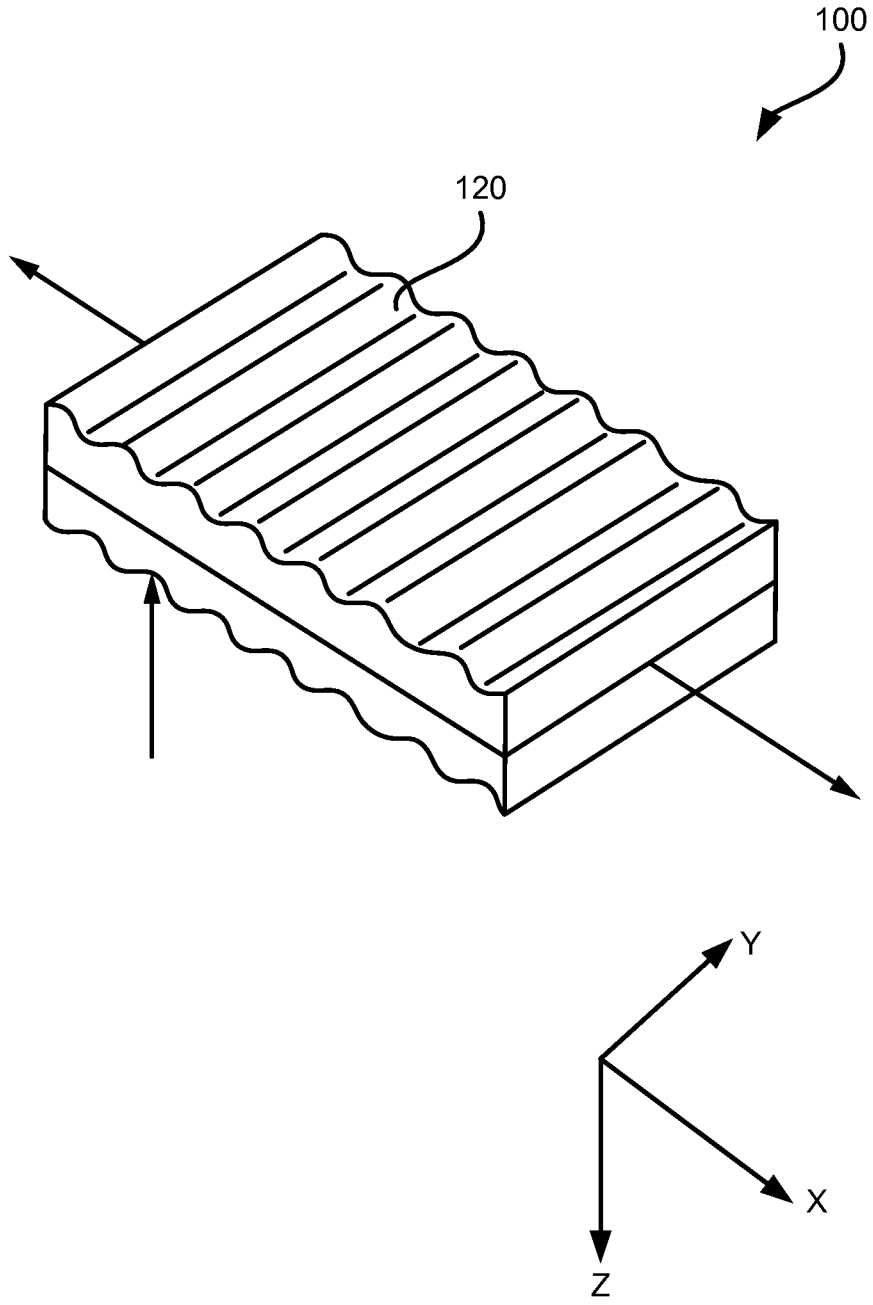
FIG. 1 depicts a representative corrugated electroactive polymer (EAP)-based actuation system in accordance with various embodiments.

The detailed description of exemplary embodiments herein makes reference to the accompanying drawings, which show exemplary embodiments by way of illustration and their best mode. While these exemplary embodiments are described in sufficient detail to enable those skilled in the art to practice the disclosure, it should be understood that other embodiments may be realized and that logical changes may be made without departing from the spirit and scope of the disclosure. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step.

According to various embodiments, an efficient heat sink configured for efficient spot-cooling based on an emerging class of stimuli-responsive materials called electroactive polymers ("EAP") is described herein. Electroactive polymers are an emerging class of stimuli-responsive materials which grow or shrink significantly in length or volume when subjected to electrical stimulation. Without desiring to bound by theory, EAPs operate by an electrostatic field acting on a dielectric film sandwiched between two electrodes that creates a so-called "Maxwell pressure." The Maxwell pressure forces the electrodes to approach each other, thereby altering the shape of the film. The efficiency of electrical motors decreases as their size decreases, and the same is true for the efficiency of fans. Even in the most efficient conventional fan-based cooling systems for electronics, the overall efficiency of converting electrical energy to air flow is less than 30%, based on losses in the electrical motor itself, as well as losses in the transfer of kinetic energy from the rotational motion of the fan to an axial flow of the air. Therefore, the majority of the electrical energy used for cooling is actually converted to heat. According to various embodiments, spot-cooling of electronics in a confined space may be accomplished. This spot cooling system results in improved efficiency results and improved cooling capacity as the amount of waste heat generated in the process is minimized.

EAPs transform electrical energy into mechanical displacement with almost no losses, offset by the efficiency of their power supply (about 80%). For instance, EAP capacitive transducers may comprise a thin polymer film where a first electrode, in the form of a first electrically conductive layer, is arranged on a first surface of the polymer film, and a second electrode, in the form of a second electrically conductive layer, is arranged on a second, opposite, surface of the polymer film. Thus, the electrodes form a capacitor with the polymer film arranged therein. If a potential difference is applied between the electrodes, the electrodes are attracted to each other, and the polymer film is compressed in a direction perpendicular to the electrodes, and elongated in a direction parallel to the electrodes. A mechanical stroke may be formed from the transducer, i.e. the electrical energy supplied to the electrodes is converted into mechanical work, i.e. the transducer acts as an actuator.

EAPs thus exhibit low weight and fast response speed for a given power density. According to various embodiments and with reference to FIG. 1, the film and the metallic electrodes attached onto the electroactive polymers of the EAP-based actuation system 100 are have corrugated configuration 120 such that large displacements can be accomplished without issues stemming from the non-compliance of typical metal electrodes. The term "corrugated" or "corrugated configuration" as used herein may refer to arrangement of the dielectric film material shaped into alternate ridges and grooves sandwiched between a plurality of electrodes (See Patent Application Number WO 2013/120494 A1 entitled "A capacitive transducer and a method for manufacturing a transducer.)"

On a per mass basis, the force density afforded by EAP-based actuation system is approximately half that of typical electromechanical systems and significantly lower than that of pneumatic or hydraulic systems. Thus, for the objectives where high force density is not an important consideration, EAPs offer a powerful combination of physical properties. i.e., direct transfer of electrical energy to mechanical displacement with 80% efficiency at a system weight that is less than ⅓ of the weight of an equivalent electromechanical actuation system. In contrast, even the most efficient conventional fan-based cooling systems with small form-factors have lower than about 30% overall efficiency of converting electrical energy to air flow, due to losses both in the small electrical motor itself as well as in the transfer of kinetic energy from the rotational motion of the fan to an axial flow of the air.

Therefore, in fan-based systems, the majority of the electrical energy used for cooling is actually converted to heat. Thus, an EAP-based actuation system and/or spot cooling scheme could be exploited to have a profound effect on cooling electronics such as for those electronics on board aircraft. The mechanical displacement of the EAP, obtained from electrical energy at very high efficiency, may be in turn converted to air flow in a direct way.

According to various embodiments, using alternating voltage at the EAP's electrodes will result in deriving an oscillatory motion such that air is drawn inside a cavity during the first half-period of the oscillation and forced outside the cavity during the second half-period.

Figure 2A:
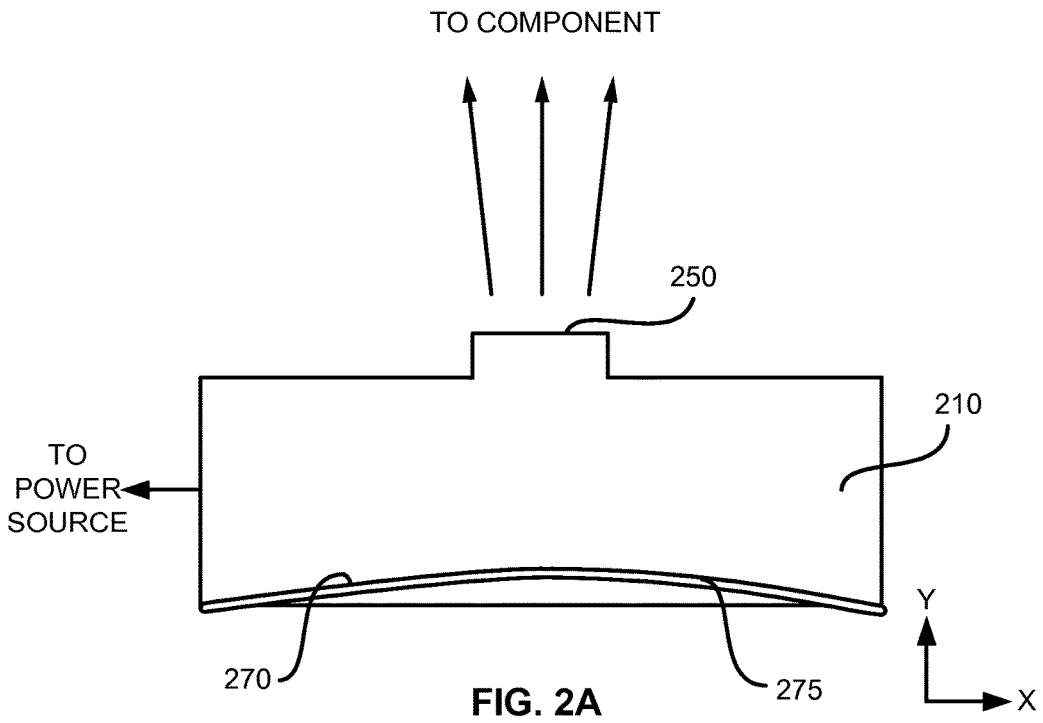
FIGS. 2A and 2B depict a representative single port diaphragm EAP-based actuation system, in accordance with various embodiments.
Figure 2B:
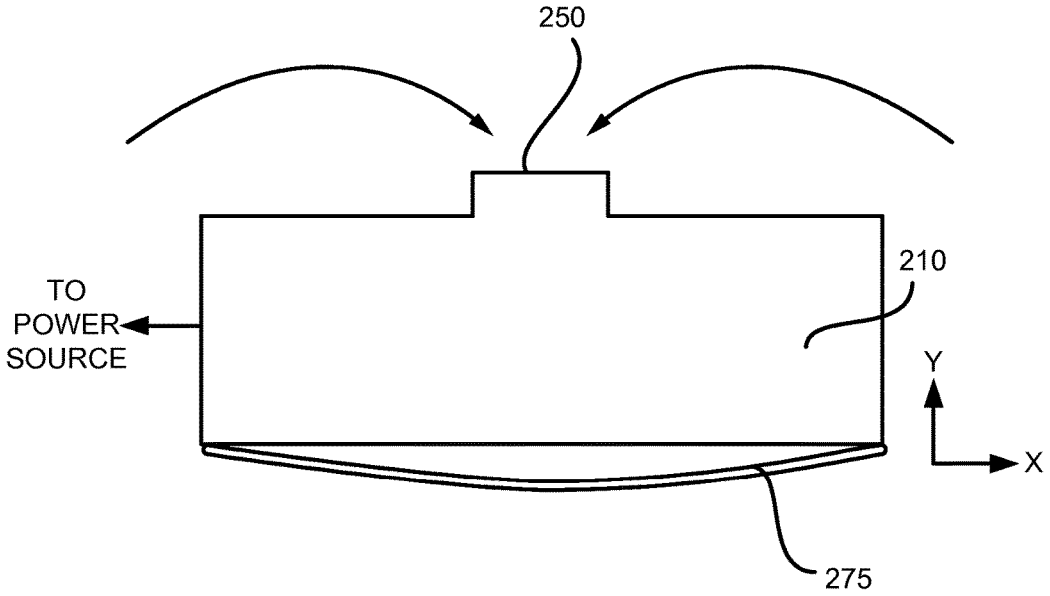

For example, the oscillatory motion of an EAP may be utilized via a "focused" air flow for spot cooling via a diaphragm, as shown schematically in FIGS. 2A and 2B. In FIG. 2A, the enclosure 210 comprises a port 250 which acts as both inlet and outlet. For example, during suction, air enters from the vicinity of the opening of the port 250 and is projected toward the internal surface 270 of the diaphragm 275; when the motion of the diaphragm 275 is reversed by the motion of the EAP's electrodes, the flow of air is projected out the port 250 toward the component to be actively cooled. Port 250 may be disposed in close proximity, (within a few 1-4 centimeters (0.3937-1.575 inch)) to a component, such as an electrical component. According to various embodiments, the diaphragm material is the EAP, such as a stack of corrugated EAP films. In this way, a bond, which could be a point of failure, between the EAP actuator and the diaphragm may be eliminated. According to various embodiments, the diaphragm material is coupled to the EAP actuator. Notably, the percent elongation of the EAP materials may be up to about 60%.

Figure 3A:
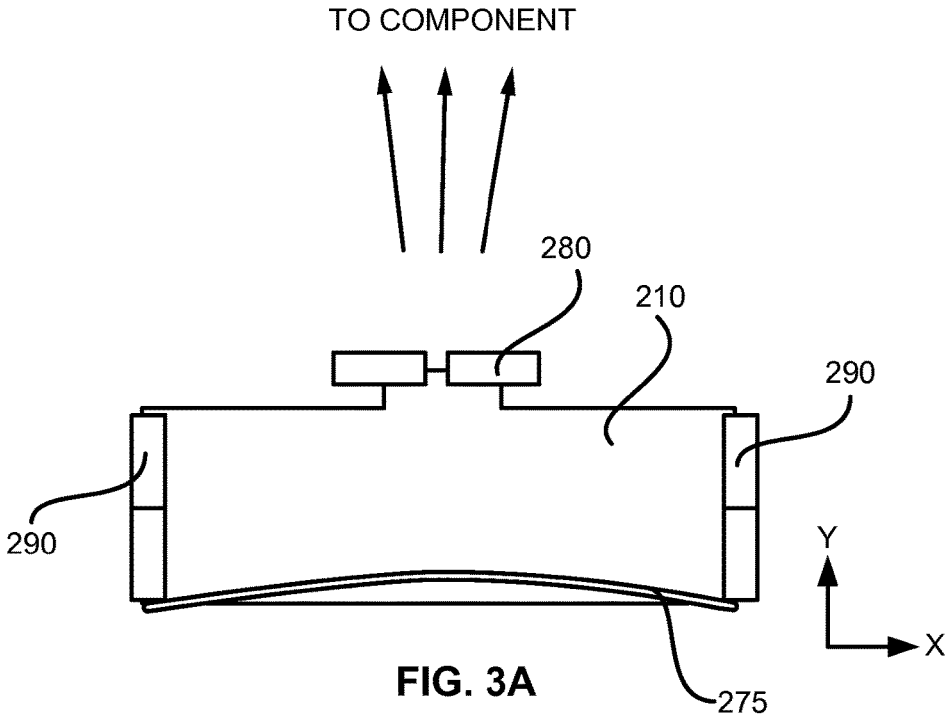
FIGS. 3A and 3B depict a representative plurality port diaphragm EAP-based actuation system, in accordance with various embodiments.
Figure 3B:
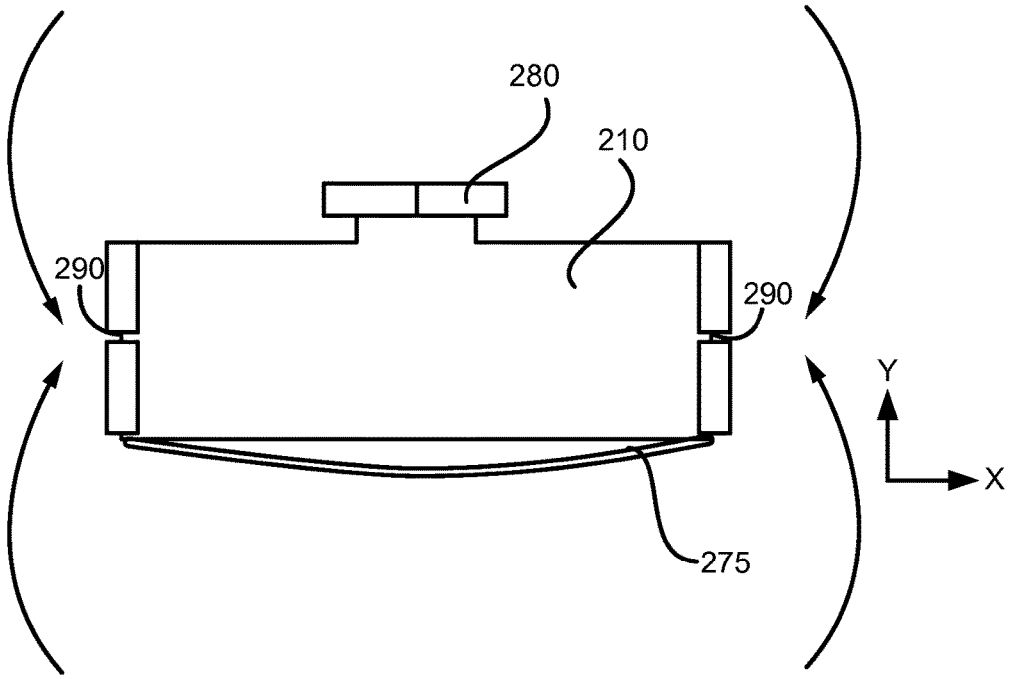

According to various embodiments, with reference to FIGS. 3A and 3B, a system comprising a plurality of check valves is illustrated, such as one-way airflow valves 280 and 290, configured to restrict leakage air flow. For example, the enclosure 210 may comprise one or more first check valve (e.g., one-way valve) 290 to allow air to flow into the enclosure 210. The air that flows into the enclosure may be cooler relative to air proximate an electrical component where spot-cooling is desired (such as external to a housing). The enclosure 210 may comprise a second check valve 280 (e.g., one-way valve) to allow air to flow from the enclosure 210 and onto and/or proximate a component to be cooled.

Figure 4A:
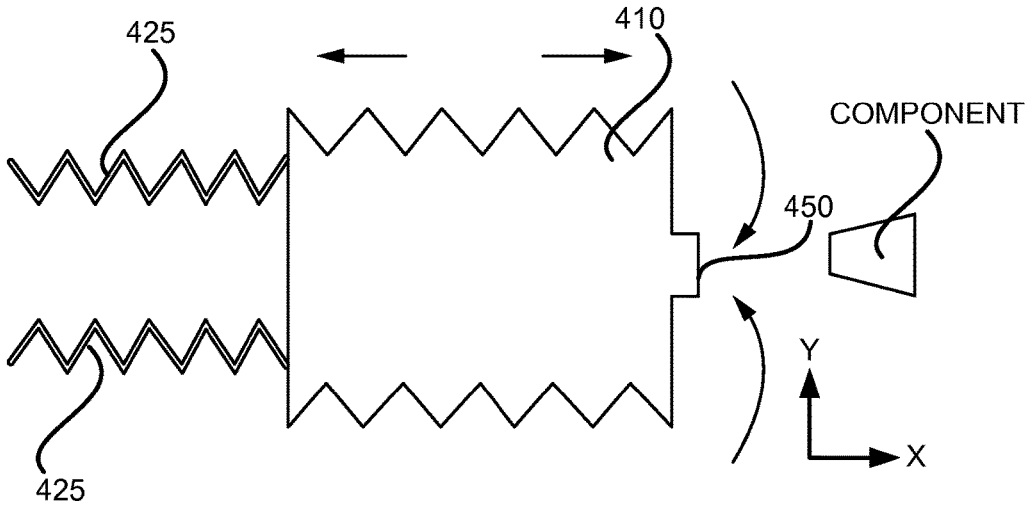
FIGS. 4A and 4B depict a representative single port bellows EAP-based actuation system, in accordance with various embodiments.
Figure 4B:
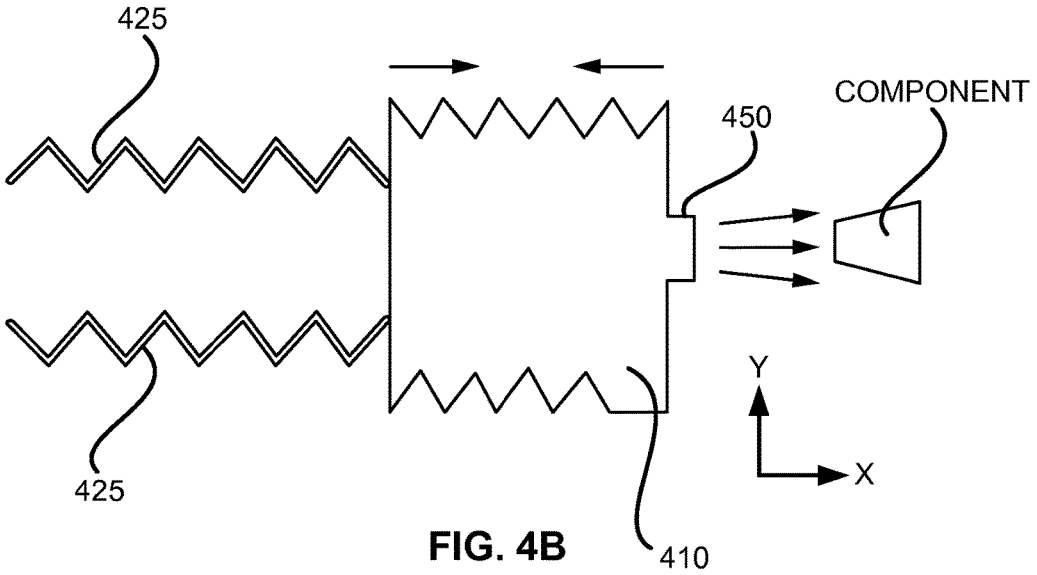

According to various embodiments, an EAP actuator system may be utilized as a means to pulsate the all or a portion of the enclosure 410, as shown schematically in FIGS. 4A and 4B. As indicated on the left side of 4A, in response to the EAP actuators 425 (depicted as springs) contracting, the flexible enclosure 410 increases its volume forcing air to enter; in response to the EAP actuators 425 expand, the volume decreases forcing air to exit.

Figure 5A:
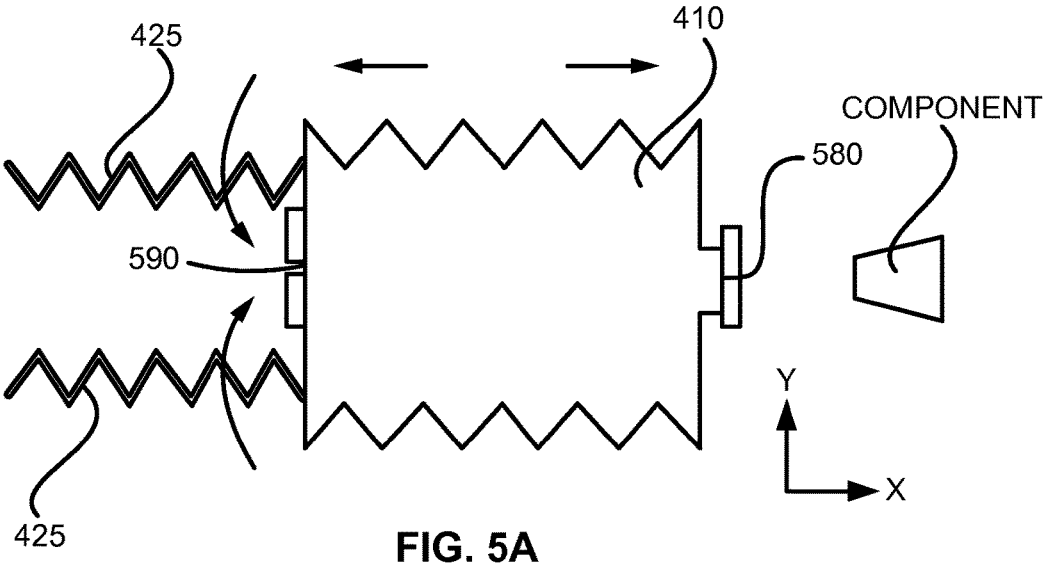
FIGS. 5A and 5B depict a representative plurality port bellows EAP-based actuation system, in accordance with various embodiments.
Figure 5B:
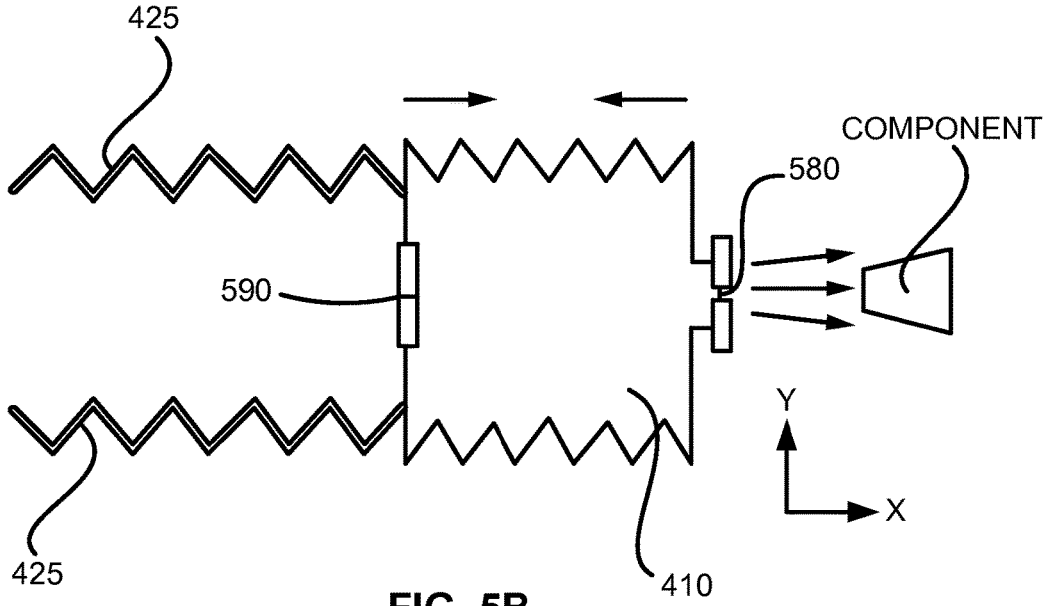

With reference to FIGS. 5A and 5B, according to various embodiments, an EAP actuator system scheme utilizing check valves 580 and 590 may be utilized as a means to pulsate the all or a portion of the enclosure 410. The check valves 580 and 590 may be configured to minimize air flow leakage and/or bring cooler air into the enclosure 410 by collecting it further away from the to-be-cooled component, as shown in FIG. 5B.

Though they may take any shape, the EAP actuators of FIGS. 5A and 5B would preferably be of cylindrical form. For the purposes of this "flexible cavity" method, the EAP actuator may be inversely proportional to its percentage of elongation at any given time. Therefore, in various embodiments, the EAP actuators may be substantially fully contracted when the enclosure 410 is fully expanded. Thus, the maximum force may be applied in response to the cavity beginning to contract, thereby allowing the air volume to be expelled quickly. It is also preferable that the cavity has the form of a "bellows", as indicated in FIGS. 4A, 4B, 5A and 5B, as opposed to comprising a stretchable elastomer, in order to minimize the work required for expansion and contraction.

Figure 6:
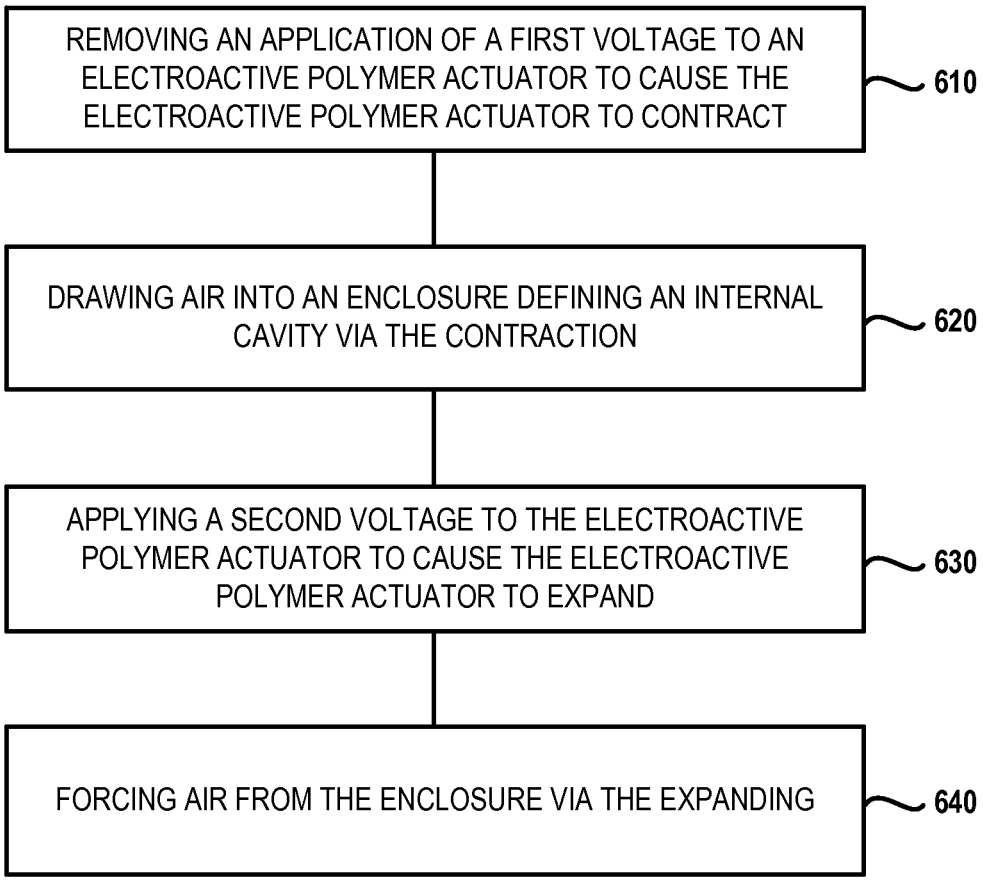
FIG. 6 illustrates a method of spot cooling utilizing an EAP-based actuation system in accordance with various embodiments.

According to various embodiments and with reference to FIG. 6, a method of spot-cooling is depicted. The method may include removing an application of a first voltage to an electroactive polymer actuator to cause the electroactive polymer actuator to contract (step 610), such as the alternating voltage described above. The method may include drawing air into an enclosure defining an internal cavity via the contraction (step 620). The method may include applying a second voltage to the electroactive polymer actuator to cause the electroactive polymer actuator to expand (step 630). The method may include forcing air from the enclosure via the expanding (step 640).

The systems and methods described herein may be utilized for active cooling for high-power computer processing chips in gaming or computer servers. The spot-cooling systems described herein may take on any desired aspect ratio. For instance, the "diaphragm pumps" described herein may be flat, or nearly flat. In this way, the aspect ratio of it can be more like a plate than a cube.

According to various embodiments, the systems and methods described herein may replace conventional systems utilizing natural convection with active spot-cooling. In this way, the active promotion of air flow may be accomplished in a system which would otherwise be cooled through buoyancy. For instance, the systems and methods described herein may be directed to hot spot-cooling and/or bulk air movement, such as bulk air flow movement through a space. The systems and methods described herein may be substantially noise free. The systems and methods described herein may eliminate the use of rotating parts. The systems and methods described herein may be used to at least one of draw hot air away from a component or actively flow relatively cooler air on a component.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more."

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments. Different cross-hatching is used throughout the figures to denote different parts but not necessarily to denote the same or different materials.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A spot-cooling system for an aircraft electrical component comprising:

a corrugated electroactive polymer actuator diaphragm;

a flexible enclosure defining an internal cavity;

a first inlet comprising a first check valve and a second inlet opposite the first inlet comprising a second check valve;

an outlet comprising a third check valve between the first inlet and the second inlet;

wherein a surface opposite the outlet of the flexible enclosure is the corrugated electroactive polymer actuator diaphragm, wherein the corrugated electroactive polymer actuator diaphragm is configured to extend thereby expanding the surface of the enclosure to draw air into the internal cavity through the inlet of the enclosure, wherein the corrugated electroactive polymer actuator diaphragm is configured to contract thereby collapsing the surface of the enclosure to force air out of the internal cavity through the outlet of the enclosure, and wherein the outlet is adjacent to the aircraft electrical component and the first inlet and second inlet are adjacent to an air source that is cooler relative to an air source near the aircraft electrical component.

2. The spot-cooling system of claim 1, wherein the corrugated electroactive polymer actuator diaphragm is configured to expand and contract along a first direction and the flexible enclosure is configured expand and contract along the first direction.

3. The spot-cooling system of claim 1, wherein the corrugated electroactive polymer actuator diaphragm comprises a thin polymer film where a first electrode, in the form of a first electrically conductive layer, is arranged on a first surface of the polymer film, and a second electrode, in the form of a second electrically conductive layer, is arranged on a second, opposite, surface of the polymer film.

4. The spot-cooling system of claim 3, wherein in response to a potential difference between the first electrode and the second electrode, the first electrode and second electrode are attracted to each other, thereby compressing the polymer film.

5. The spot cooling system of claim 1, wherein the first, second, and third check valves are configured to restrict leakage airflow.

6. The spot cooling system of claim 1, wherein the cooler air source is external to a housing of the internal cavity.

7. The spot cooling system of claim 1, wherein the third check valve is configured to close and the first check valve and second check valve are configured to open as air is drawn into the internal cavity.

8. The spot cooling system of claim 1, wherein the third check valve is configured to open and the first check valve and second check valve are configured to close as air is forced from the internal cavity.

* * * * *